US006692343B2

(12) United States Patent
Hirata et al.

(10) Patent No.: US 6,692,343 B2
(45) Date of Patent: Feb. 17, 2004

(54) SUPERABRASIVE WHEEL FOR MIRROR FINISHING

(75) Inventors: Takahiro Hirata, Hyogo (JP); Yukio Okanishi, Hyogo (JP)

(73) Assignee: A.L.M.T. Corp., Taito-ku (JP)

( * ) Notice: Subject to any disclaimer, the term of this patent is extended or adjusted under 35 U.S.C. 154(b) by 63 days.

(21) Appl. No.: 10/111,164

(22) PCT Filed: Aug. 9, 2001

(86) PCT No.: PCT/JP01/06887

§ 371 (c)(1),
(2), (4) Date: Apr. 19, 2002

(87) PCT Pub. No.: WO02/22310

PCT Pub. Date: Mar. 21, 2002

(65) Prior Publication Data

US 2003/0003858 A1 Jan. 2, 2003

(30) Foreign Application Priority Data

Sep. 13, 2000 (JP) ..... 2000-277845

(51) Int. Cl.[7] ..... B23F 21/03
(52) U.S. Cl. ..... 451/548; 451/550
(58) Field of Search ..... 451/56, 443, 548, 451/550, 547

(56) References Cited

U.S. PATENT DOCUMENTS

| | | | | |
|---|---|---|---|---|
| 2,307,632 A | * | 1/1943 | Meyer | |
| 5,911,620 A | * | 6/1999 | Spangenberg et al. | 451/548 |
| 6,120,350 A | * | 9/2000 | Zhou et al. | 451/21 |
| 6,217,433 B1 | * | 4/2001 | Herrman et al. | 451/548 |
| 6,277,017 B1 | * | 8/2001 | Ji | 451/547 |
| 6,293,854 B1 | * | 9/2001 | Kimura et al. | 451/56 |
| 6,299,522 B1 | * | 10/2001 | Lee | 451/548 |

FOREIGN PATENT DOCUMENTS

| | | |
|---|---|---|
| JP | 54-137789 | 10/1979 |
| JP | 63 134174 | 6/1988 |
| JP | 07 299754 | 11/1995 |
| JP | 07-328930 | 12/1995 |
| JP | 11 179667 | 7/1999 |
| JP | 11 207635 | 8/1999 |
| JP | 29 76806 | 11/1999 |
| JP | 11 300626 | 11/1999 |
| JP | 2000 301468 | 10/2000 |

* cited by examiner

*Primary Examiner*—Eileen P. Morgan
(74) *Attorney, Agent, or Firm*—W. F. Fasse; W. G. Fasse

(57) ABSTRACT

A superabrasive wheel (100, 200) for mirror finishing includes an annular base plate (120, 220) having an annular end surface (121, 221) and a plurality of superabrasive members (110, 210), each having a peripheral end surface (111), arranged along the periphery of the annular base plate (120, 220) at intervals from each other in a circumferential direction and fixed onto the end surface (121, 221) of the base plate (120, 220). Each of the superabrasive members (110, 210) has a flat plate shape, and is so arranged that the peripheral end surface (111) is substantially parallel to the rotary shaft of the superabrasive wheel (100, 200). A surface (113) defined by the thickness of the flat plate shape of each superabrasive member (110, 210) is fixed onto the end surface (121, 221) of the base plate (120, 220). In the superabrasive members (110, 210), superabrasive grains are bonded by a binder of a vitrified bond. In another superabrasive wheel (300, 400) for mirror finishing, each one of plural superabrasive members (310, 410) has an angularly bent V-shaped plate configuration or a curved C-shaped plate configuration, and is so arranged that a peripheral end surface (311) thereof is substantially parallel to the rotary shaft of the superabrasive wheel (300, 400).

23 Claims, 10 Drawing Sheets

SUPERABRASIVE WHEEL FOR MIRROR FINISHING

TECHNICAL FIELD

The present invention generally relates to a superabrasive wheel, and more specifically, it relates to a superabrasive wheel for mirror finishing employed for mirror-finishing a hard brittle material such as silicon, glass, ceramics, ferrite, rock crystal, cemented carbide or the like.

BACKGROUND ART

Recently, high-precision mirror finishing of a material is required following abrupt technical innovation such as high integration of a semiconductor device or ultraprecision in working of ceramics, glass, ferrite or the like. Such mirror finishing is generally performed by grinding referred to as lapping. More specifically, free abrasive grains mixed into a lapping solution are fed between a lapping surface plate and a workpiece and rubbed with each other while applying pressure to the lapping surface plate and the workpiece in this grinding, for grinding the workpiece due to rolling and scratching actions of the free abrasive grains and providing a highly precise mirror-finished surface on the workpiece. In this lapping, however, a large quantity of free abrasive grains are consumed to result in a large quantity of mixture, referred to as sludge, of used freed abrasive grains, chips caused by cutting the workpiece and the lapping solution, disadvantageously leading to deterioration of the working environment and pollution.

Therefore, mirror finishing employing fixed fine superabrasive grains is actively studied/developed as a method substitutable for the aforementioned grinding employing free abrasive grains. As such mirror finishing employing fixed fine superabrasive grains, well known is machining with a resin bond superabrasive wheel elastically holding superabrasive grains of several $\mu$m in mean grain size or ELID (electrolytic in-progress dressing) grinding of dressing a metal bond superabrasive wheel while electrolytically dissolving a bond material for grinding a material with the metal bond superabrasive wheel.

In the aforementioned machining employing a resin bond superabrasive wheel, however, the sharpness of a grindstone is deteriorated due to the fine superabrasive grains, and the grindstone is so remarkably worn that the worked surface of a workpiece is readily changed in shape or reduced in precision and the grindstone must be frequently trued and dressed.

In the aforementioned working method employing a metal bond superabrasive wheel, the rigidity of the metal bond material is so high that superabrasive grains finer than those in the resin bond superabrasive wheel must be used for obtaining a mirror-finished state substantially identical to the worked surface of the workpiece obtained by the machining employing the resin bond superabrasive wheel, to result in further deterioration of the sharpness of the grindstone.

In order to solve the problem of sharpness, a vitrified bond may be used as the binder while reducing the area of a superabrasive layer. For example, a number of grooves may be formed in a superabrasive layer employing a vitrified bond as the binder, so that superabrasive layers contributing to grinding are formed at intervals from each other. When employing a superabrasive wheel formed with such superabrasive layers, not only the conventional grinding employing free abrasive grains can be changed to grinding employing fixed superabrasive grains but also a vitrified bond superabrasive wheel for mirror finishing having remarkably excellent sharpness and a long life can be provided by performing truing and dressing with a diamond rotary dresser (hereinafter referred to as an RD). This is because large-volume pores of the vitrified bond serve as chip pockets for smoothly discharging chips and enabling highly efficient machining, so that the workpiece can be mirror-finished with small surface roughness.

In the aforementioned vitrified bond superabrasive wheel for mirror finishing, a plurality of segment superabrasive layers are arranged along the peripheral direction of an annular base plate at intervals from each other. Depending on the size or the shape of the segments, however, superabrasive grains crushed or falling during mirror finishing or shavings may be caught between the superabrasive layers and the workpiece, to cause scratches on the surface of the workpiece. Further, a long time is required for a step of removing such scratches.

For example, Japanese Patent No. 2976806 proposes a structure of a segment grindstone. This segment grindstone is formed with segment fixing grooves so that a plurality of abrasive layer segments are engaged in the segment fixing grooves respectively. When performing grinding with the segment grindstone having such a structure, however, the segment fixing grooves are clogged with shavings, and dischargeability for such shavings is extremely deteriorated.

Japanese Patent Laying-Open No. 54-137789 (1979) proposes a structure of a segment type grindstone for surface grinding. In the segment type grindstone disclosed in this gazette, superabrasive layers are formed by sintering superabrasive grains with a binder such as a metal bond or a resin bond. When arranging superabrasive layers of plate segments shown in FIG. 4 or FIG. 6 of this gazette along the peripheral direction of an annular base plate at intervals from each other, grinding resistance is disadvantageously increased due to the metal bond or the resin bond employed as the binder, although dischargeability for shavings is improved. Therefore, sharpness is deteriorated in grinding and the superabrasive layers are readily displaced from the base plate. The superabrasive layers are frequently displaced as the quantity of grinding is increased, to result in scratches. Consequently, the life of the grindstone is disadvantageously reduced.

The aforementioned gazette further proposes a structure of a segment type grindstone for surface grinding formed by arranging segment tips of cylindrically formed superabrasive layers along the peripheral direction of an annular base plate at intervals from each other in FIG. 1. However, although such cylindrical superabrasive layers are hardly displaced from the base plate in grinding, the inner sides of the cylindrical superabrasive layers are readily clogged with shavings and dischargeability for such shavings is disadvantageously deteriorated.

Accordingly, an object of the present invention is, in order to solve the aforementioned problems, to provide a superabrasive wheel for mirror finishing improved in dischargeability for superabrasive grains crushed or falling during mirror finishing or shavings to hardly cause scratches, capable of performing efficient machining and also capable of preventing scratches caused by displacement of a segment superabrasive layer by rendering the superabrasive layer hardly displaceable from a base plate.

SUMMARY OF INVENTION

According to a first aspect of the present invention, a superabrasive wheel for mirror finishing, comprising an annular base plate having an end surface and a plurality of superabrasive layers or members, each having a peripheral end surface, arranged along the peripheral direction of this annular base plate at intervals from each other and fixed onto the end surface of the base plate, has the following characteristics. Each of the plurality of superabrasive layers or members has a flat plate shape, and is so arranged that the peripheral end surface is substantially parallel to the rotary shaft of the superabrasive wheel. A surface defined by the thickness of the flat plate shape of each of the plurality of superabrasive layers, i.e., a surface along the direction of the thickness of the flat plate shape is fixed onto the end surface of the base plate. Superabrasive grains are bonded by a binder of a vitrified bond in the superabrasive layers.

In the superabrasive wheel having the aforementioned structure, the surface defined by the thickness is fixed onto the end surface of the base plate in each of the superabrasive layers having the flat plate shape, whereby sufficient clearances can be defined between the superabrasive layers and dischargeability for chips and shavings can be improved.

Further, the peripheral end surface of each superabrasive layer is arranged to be substantially parallel to the rotary shaft of the superabrasive wheel so that the position of a working surface of each superabrasive layer is kept substantially constant with respect to a workpiece in in-feed grinding although the superabrasive layer may be worn as the grinding progresses, whereby a stable working mode can be sustained. Therefore, the working surface of each superabrasive layer can be regularly brought into contact with the central portion of the workpiece. Thus, the finished surface of the workpiece is flattened.

In particular, the superabrasive grains are bonded by the binder of the vitrified bond in the flat-shaped superabrasive layers of the aforementioned superabrasive wheel, whereby grinding resistance can be reduced during grinding. Therefore, the superabrasive layers can be rendered hardly displaceable during grinding. Thus, the surface of the workpiece can be prevented from scratches resulting from displacement of the superabrasive layers.

Also when the quantity of working is increased, the grinding resistance can be kept low. Thus, reduction of the life resulting from displacement of the superabrasive layers can be prevented.

In the aforementioned superabrasive wheel for mirror finishing according to the first aspect, the superabrasive layers preferably have working surfaces substantially perpendicular to the rotary shaft of the superabrasive wheel, and the working area of the plurality of superabrasive layers preferably has a ratio of at least 5% and not more than 80% with respect to the area of a ring shape defined by a line connecting the outer peripheral edges of the plurality of superabrasive layers with each other and a line connecting the inner peripheral edges of the plurality of superabrasive layers with each other.

In the superabrasive wheel according to the present invention, each superabrasive layer is brought into the flat plate shape, thereby enabling control of reducing the area ratio of the working surface of the superabrasive layer and increasing the force acting on each superabrasive grain with respect to such continuous type superabrasive layers that integrated continuous superabrasive layers are formed on the end surface of the superabrasive wheel. Thus, grindability of the superabrasive wheel can be improved while an autogenous action of the superabrasive wheel can be smoothed. Assuming that the radial widths of the superabrasive layers having the flat plate shape are identical to each other, the area of the working surfaces of the plurality of superabrasive layers having a flat plate shape is preferably set to a ratio within the range of 5 to 80% of the area of the continuous type superabrasive layers, more preferably set within the range of 10 to 50%. Thus, working pressure of 2 to 10 times with respect to the continuous type superabrasive layers is applied to the working surface of each superabrasive layer of the flat plate shape in the superabrasive wheel according to the present invention, and a state of excellent sharpness can be sustained.

In the superabrasive wheel for mirror finishing according to the first aspect of the present invention, the superabrasive layers preferably contain superabrasive grains of at least 0.1 $\mu$m and not more than 100 $\mu$m in mean grain size. Synthetic superabrasive grains for a resin bond are suitable as the contained superabrasive grains. The synthetic superabrasive grains for a resin bond, having higher crushability as compared with synthetic superabrasive grains for a metal bond or a saw blade, are particularly preferable since small inserts can be formed on the forward ends of the superabrasive grains by truing and dressing with an RD.

As synthetic diamond superabrasive grains for a resin bond, RVM or RJK1 (trade name) by GE Superabrasives, IRM (trade name) by Tomei Diamond Kabushiki Kaisha or CDA (trade name) by De Beers can be applied. As the synthetic diamond superabrasive grains for a resin bond, BMP1 (trade name) by GE Superabrasives or SBNB, SBNT or SBNF (trade name) by Showa Denko K.K. can be applied.

While an RD is most preferably employed for performing truing and dressing in consideration of efficiency and molding precision, it is also possible to employ a metal bond grindstone or an electrodeposition grindstone having a diamond grain size of about #30 (grain diameter: 650 $\mu$m) with no dispersion in forward end height of diamond abrasive grains.

According to a second aspect of the present invention, a superabrasive wheel for mirror finishing comprising an annular base plate having an end surface and a plurality of superabrasive layers or members, each having a peripheral end surface, arranged along the peripheral direction of the annular base plate at intervals from each other and fixed onto the end surface of the base plate, has the following characteristics. Each of the plurality of superabrasive layers or members has an angularly or curvedly bent plate shape, e.g. a V-shaped bent plate configuration, or a C-shaped curved plate configuration, and is so arranged that the peripheral end surface is substantially parallel to the rotary shaft of the superabrasive wheel. A surface defined by the thickness of the plate shape of each of the plurality of superabrasive layers is fixed onto the end surface of the base plate.

In the superabrasive wheel having the aforementioned structure, the surface defined by the thickness of the plate shape of each of the superabrasive layers, i.e., the surface along the direction of the thickness of the plate shape is fixed onto the end surface of the base plate similarly to the aforementioned superabrasive wheel according to the first aspect, whereby sufficient clearances can be defined between the plurality of superabrasive layers so that dischargeability for shavings and chips can be improved.

Further, each of the superabrasive layers is so arranged that the peripheral end surface is substantially parallel to the rotary shaft of the superabrasive wheel similarly to the aforementioned superabrasive wheel according to the first aspect, whereby the position of a working surface of each superabrasive layer remains substantially constant with respect to a workpiece also when the superabrasive layer is worn as grinding progresses in in-feed grinding, so that a stable working mode can be sustained. Therefore, the working surface of the superabrasive layer can be regularly brought into contact with the central portion of the workpiece. Thus, the finished surface of the workpiece is flattened.

Particularly in the superabrasive wheel according to the second aspect of the present invention, each of the plurality of superabrasive layers has the angularly bent plate shape. The surface defined by the thickness of the angular plate shape is fixed onto the end surface of the base plate, i.e., the shape of the surface of the superabrasive layer fixed to the end surface of the base plate is angular, whereby each superabrasive layer is strengthened against resistance in the vertical direction and the rotational direction of the superabrasive wheel applied to the superabrasive layer in grinding, to be hardly displaced from the end surface of the base plate. Thus, the surface of the workpiece can be prevented from scratches resulting from displacement of the superabrasive layer.

In the superabrasive layers of the superabrasive wheel for mirror finishing according to the second aspect of the present invention, superabrasive grains are preferably bonded by a binder of a vitrified bond. The vitrified bond can reduce grinding resistance in grinding as the binder, and hence the superabrasive layers can be rendered more hardly displaceable from the end surface of the base plate. Thus, the surface of the workpiece can be more effectively prevented from scratches resulting from displacement of the superabrasive layers. Further, the vitrified bond, acting to smooth an autogenous action of the superabrasive wheel as the binder, contributes to sustainment of excellent sharpness.

In the superabrasive layers of the superabrasive wheel for mirror finishing according to the second aspect of the present invention, superabrasive grains are preferably bonded by a binder of a resin bond. The resin bond, acting to smooth the autogenous action of the superabrasive wheel as the binder similarly to the aforementioned vitrified bond, contributes to sustainment of excellent sharpness. Further, the resin bond having an elastic action as the binder effectively reduces the sizes of scratches formed on the surface of the workpiece during grinding, thereby reducing surface roughness of the workpiece.

In the superabrasive wheel for mirror finishing according to the second aspect of the present invention, each of the plurality of superabrasive layers is preferably so arranged that an angularly bent portion is located on the inner peripheral side of superabrasive wheel. An open part opposite to the angularly bent and closed part is located on the outer peripheral side of the superabrasive wheel due to this structure, whereby shavings and chips caused during grinding can be readily discharged from the open part. Thus, dischargeability for shavings can be improved.

Each of the plurality of superabrasive layers preferably has a plate shape bent in a V shape. When each superabrasive layer of the plate shape is bent in the V shape, the superabrasive layer is strengthened against resistance in the vertical direction and the rotational direction of the superabrasive wheel applied to each superabrasive layer during grinding, to be more hardly displaceable from the end surface of the base plate. Therefore, it is possible to prevent occurrence of scratches resulting from displacement of the superabrasive layer during grinding.

When each of the superabrasive layers has the plate shape bent in the V shape, the apical angle of the V shape is preferably at least 30° and not more than 150°. The apical angle of the V shape is set to at least 30°, in order to efficiently discharge shavings and chips during grinding. Further, the apical angle of the V shape is set to not more than 150°, so that a grinding fluid can be efficiently fed to a ground surface of the workpiece and the superabrasive layers are hardly displaceable from the end surface of the base plate against resistance in grinding. In order to improve these effects, the apical angle of the V shape is more preferably set to at least 45° and not more than 90°.

As to the size of each superabrasive layer having the plate shape bent in the V shape, the length of a single side of the V shape, the thickness of the plate shape forming the V shape and the height of the plate shape forming the V shape, i.e., the length along the direction of the rotary shaft of the superabrasive wheel are preferably set to 2 to 20 mm, 0.5 to 5 mm and 3 to 10 mm respectively. More preferably, the length of a single side forming the V shape, the thickness of the plate shape forming the V shape and the height of the plate shape forming the V shape are set to 3 to 15 mm, 1 to 3 mm and 3 to 10 mm respectively. Further, the superabrasive layers having the plate shape bent in the V shape are preferably fixed onto the end surface of the base plate along the peripheral direction of the annular base plate at intervals of 0.5 to 20 mm from each other, and the intervals are more preferably set to 1 to 10 mm. The intervals between the superabrasive layers are preferably properly decided in response to grinding conditions and the type of the workpiece.

In the superabrasive wheel for mirror finishing according to the second aspect of the present invention, each of the plurality of superabrasive layers preferably has a plate shape bent to have a curved surface. In other words, a corner portion preferably has a radius of curvature in the bent shape of the superabrasive layer. When each superabrasive layer has the plate shape bent to have a curved surface, the grinding fluid can be efficiently fed while shavings and chips can be effectively discharged similarly to the case of the plate shape bent in the V shape, and the superabrasive layer is hardly displaceable from the end surface of the base plate against resistance in grinding. Thus, scratches resulting from displacement of the superabrasive layer can be prevented in grinding. A semicylindrical shape obtained by halving a cylindrical shape, a U shape, a C shape or the like can be employed as the plate shape bent to have a curved surface.

In the superabrasive wheel for mirror finishing according to the second aspect of the present invention, the superabrasive layers preferably have working surfaces substantially perpendicular to the rotary shaft of the superabrasive wheel, and the working area of the plurality of superabrasive layers preferably has a ratio of at least 5% and not more than 80% with respect to the area of a ring shape defined by a line connecting the outer peripheral edges of the plurality of superabrasive layers with each other and a line connecting the inner peripheral edges of the plurality of superabrasive layers with each other.

The shape of each superabrasive layer is brought into the plate shape thereby enabling control of reducing the area ratio of the working surface of the superabrasive layer and increasing the force acting on each superabrasive grain with respect to such a continuous type superabrasive layer that a single integrated continuous superabrasive layer is formed on the end surface of the superabrasive wheel, improving grindability and smoothing the autogenous action of the superabrasive wheel. Assuming that the radial lengths of the superabrasive layers are identical to each other, the area of the working surfaces of the plurality of superabrasive layers is preferably set to 5 to 80% of the area of the continuous type superabrasive layer, more preferably set within the range of 10 to 50%. Thus, working pressure of 2 to 10 times with respect to the continuous type superabrasive layer is applied to the working surface of each superabrasive layer in the superabrasive wheel according to the present invention, and a state of excellent sharpness can be sustained.

In the superabrasive wheel for mirror finishing according to the second aspect of the present invention, the superabrasive layers preferably contain superabrasive grains of at least 0.1 $\mu$m and not more than 100 $\mu$m in mean grain size. When employing a vitrified bond or a resin bond as a binder for the superabrasive wheel according to the second aspect of the present invention, synthetic superabrasive grains for a resin bond are suitable as the contained superabrasive grains. The synthetic superabrasive grains for a resin bond, having higher crushability as compared with synthetic superabrasive grains for a metal bond or a saw blade, are particularly preferable since small inserts can be formed on the forward ends of the superabrasive grains by truing and dressing with an RD.

As synthetic diamond superabrasive grains for a resin bond, RVM or RJK1 (trade name) by GE Superabrasives, IRM (trade name) by Tomei Diamond Kabushiki Kaisha or CDA (trade name) by De Beers can be applied. As the synthetic diamond superabrasive grains for a resin bond, BMP1 (trade name) by GE Superabrasives or SBNB, SBNT or SBNF (trade name) by Showa Denko K.K. can be applied.

While an RD is most preferably employed for truing and dressing the superabrasive wheel according to the present invention in consideration of efficiency and molding precision, it is also possible to employ a metal bond grindstone or an electrodeposition grindstone having a diamond grain size of about #30 (grain diameter: 650 $\mu$m) with no dispersion in forward end, height of diamond abrasive grains.

When employing the superabrasive wheel for mirror finishing according to the present invention for grinding, as hereinabove described, it is possible to effectively prevent superabrasive grains crushed or falling during grinding or shavings and chips from being caught between the superabrasive layers and the workpiece and causing scratches on the surface of the workpiece. Thus, dischargeability for superabrasive grains or shavings can be improved while the superabrasive layers are hardly displaceable from the end surface of the base plate during grinding, whereby scratches resulting from displacement of the superabrasive layers can also be prevented.

DETAILED DESCRIPTION OF THE BEST MODE FOR CARRYING OUT THE INVENTION (First Embodiment)

Figure 1:
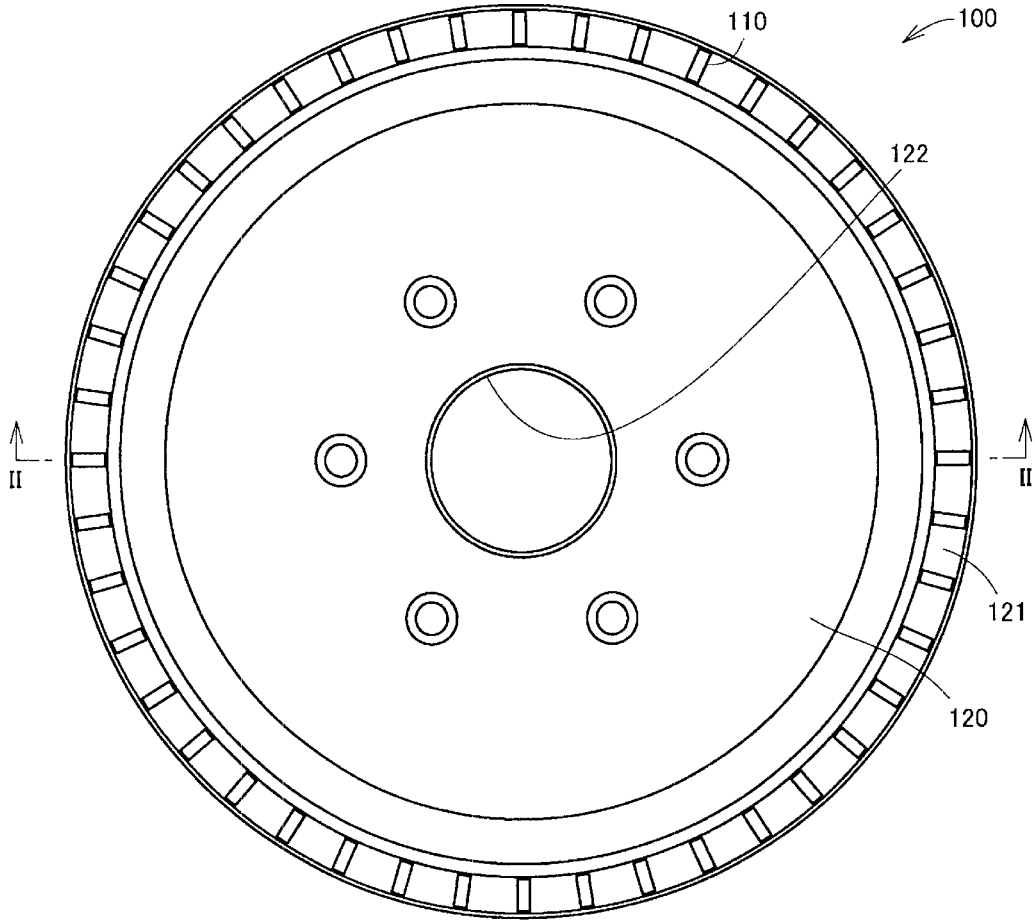
FIG. 1 is a plan view showing a superabrasive wheel according to an embodiment of the present invention.
Figure 2:
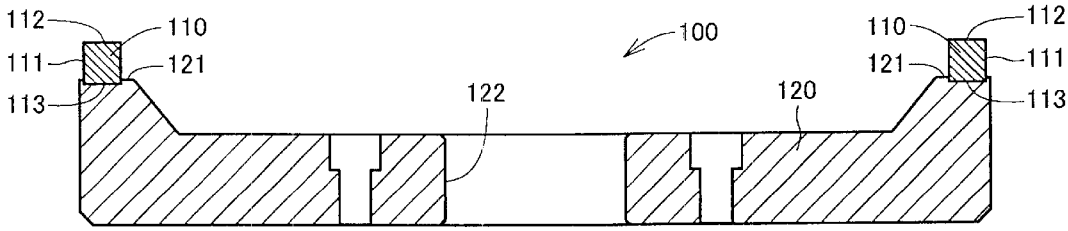
FIG. 2 is a sectional end view of the superabrasive wheel taken along the line II—II in FIG. 1.

As shown in FIGS. 1 and 2, a superabrasive wheel 100 according to a first embodiment of the present invention is formed by a cup-shaped base plate 120 made of an aluminum alloy or the like and a plurality of flat superabrasive layers or plate-shaped members 110 fixed onto a single end surface 121 of the base plate 120 at intervals from each other along the peripheral direction. Surfaces defining the thickness of the superabrasive layers 110, i.e., surfaces 113 along the direction of the thickness are fixed to circumferential grooves of a prescribed width formed in the single end surface 121 of the base plate 120. Each superabrasive layer 110 is fixed to the single end surface 121 of the base plate 120 so that a peripheral end surface 111 of the superabrasive layer 110 is substantially parallel to the rotary shaft of the superabrasive wheel 110 and the longitudinal direction of the superabrasive layer 110 is along the radial direction of the superabrasive wheel 100. Each superabrasive layer 110 has a working surface 112 substantially perpendicular to the rotary shaft of the superabrasive wheel 110. A hole 122 for receiving the rotary shaft of the superabrasive wheel 100 is formed in the central portion of the base plate 120.

(Second Embodiment)

Figure 3:
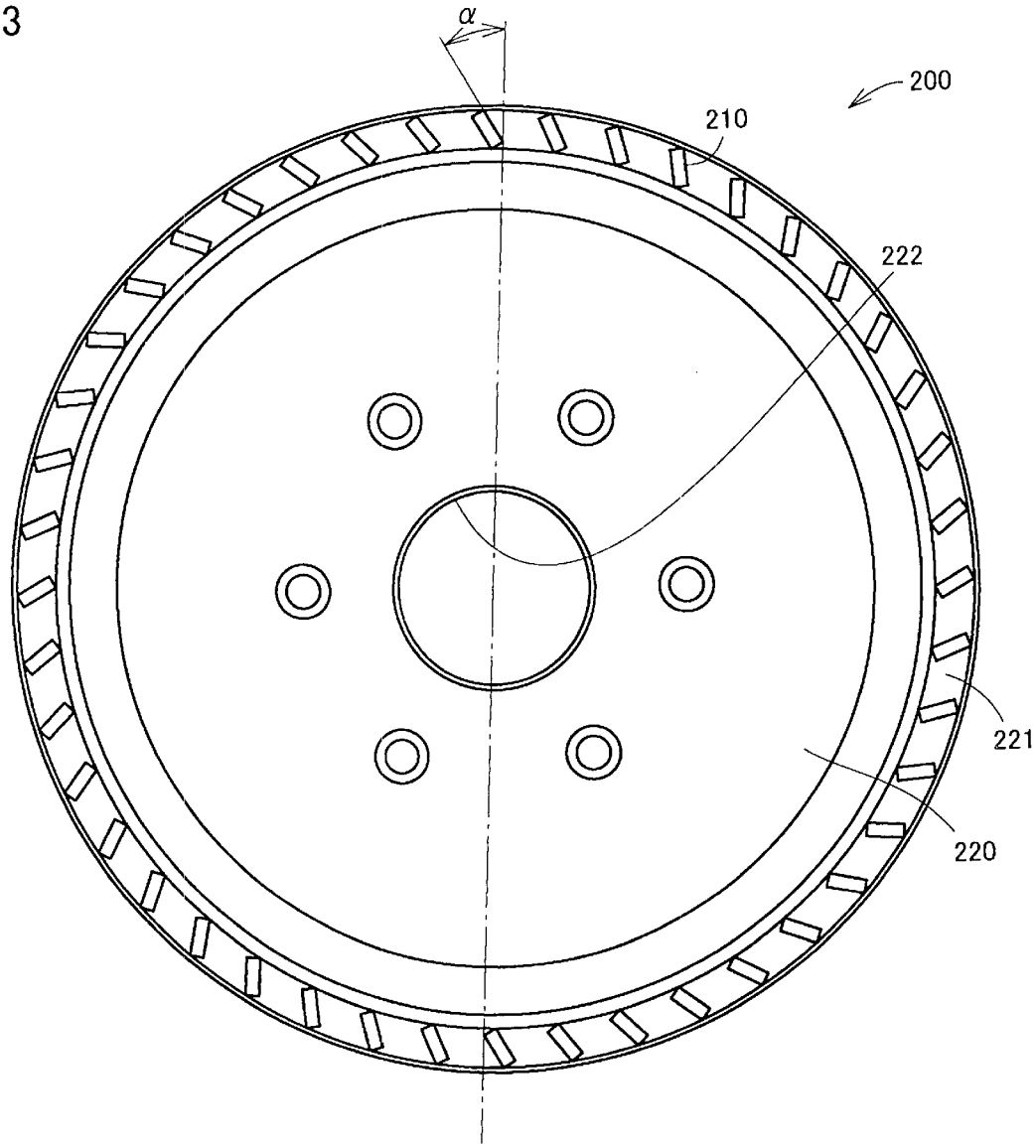
FIG. 3 is a plan view of a superabrasive wheel according to a second embodiment of the present invention.
Figure 4:
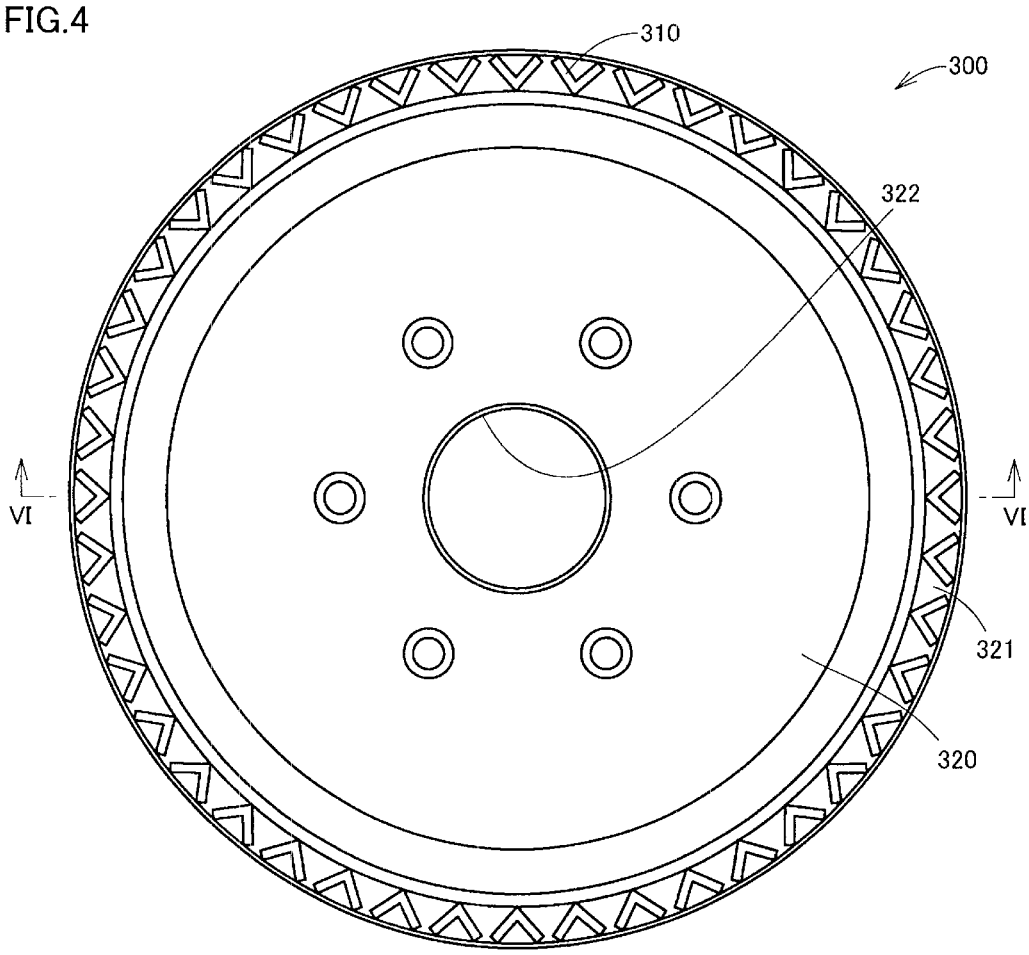
FIG. 4 is a plan view of a superabrasive wheel according to a third embodiment of the present invention.
Figure 5:
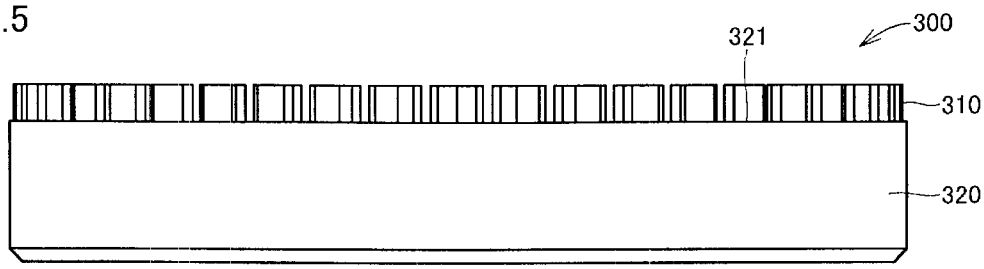
FIG. 5 is a side elevational view of the superabrasive wheel shown in FIG. 4.
Figure 6:
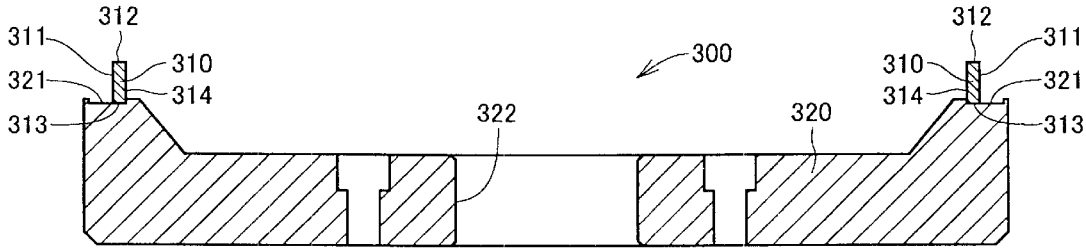
FIG. 6 is a sectional end view of the superabrasive wheel taken along the line VI—VI in FIG. 4.
Figure 7:
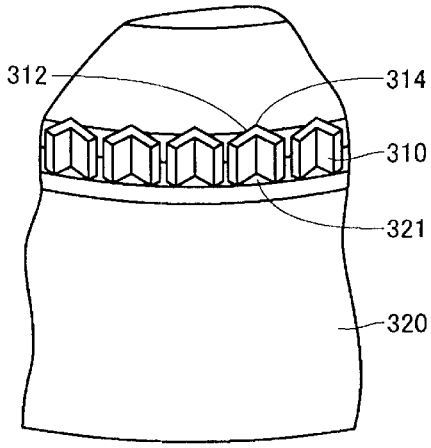
FIG. 7 is a partially fragmented perspective view showing a superabrasive layer portion of the superabrasive wheel shown in FIG. 4.

As shown in FIG. 3, a superabrasive wheel 200 according to a second embodiment of the present invention is formed by a cup-shaped base plate 220 made of an aluminum alloy or the like and a plurality of flat superabrasive layers or plate members 210 fixed onto a single end surface 221 of the base plate 220 at intervals front each other along the peripheral direction. The superabrasive wheel 200 according to the second embodiment is different from the superabrasive wheel 100 shown in FIGS. 1 and 2 in a point that each superabrasive layer 210 is fixed onto the single end surface 221 of the base plate 220 so that the longitudinal direction of each superabrasive layer 210 of the superabrasive wheel 220 is at an angle $\alpha$ with respect to the radial direction of the superabrasive wheel 200.

(Third Embodiment)

As shown in FIGS. 4 to 7, a superabrasive wheel 300 according to a third embodiment of the present invention is formed by a cup-shaped base plate 320 made of an aluminum alloy or the like and a plurality of superabrasive layers or members 310, having an angularly bent plate shape, fixed onto a single end surface 321 of the base plate 320 at intervals from each other along the peripheral direction. A surface 313 defined by the thickness of the plate shape of each superabrasive layer 310 is fixed to a circumferential groove of a prescribed width formed on the end surface of the base plate 320. Each superabrasive layer 310 is fixed onto the single end surface 321 of the base plate 320 so that a peripheral end surface 311 of each superabrasive layer 310 is substantially parallel to the rotary shaft of the superabrasive wheel 300 and a bent portion 314 of each superabrasive layer 310 is located on the inner peripheral side of the superabrasive wheel 300. In this embodiment, the superabrasive layer 310, having a V-shape as the angularly bent plate shape, is so fixed onto the single end surface 313 of the base plate 320 that an apical part 314 of the V-shape is located on the inner peripheral side of the superabrasive wheel 300.

(Fourth Embodiment)

Figure 8:
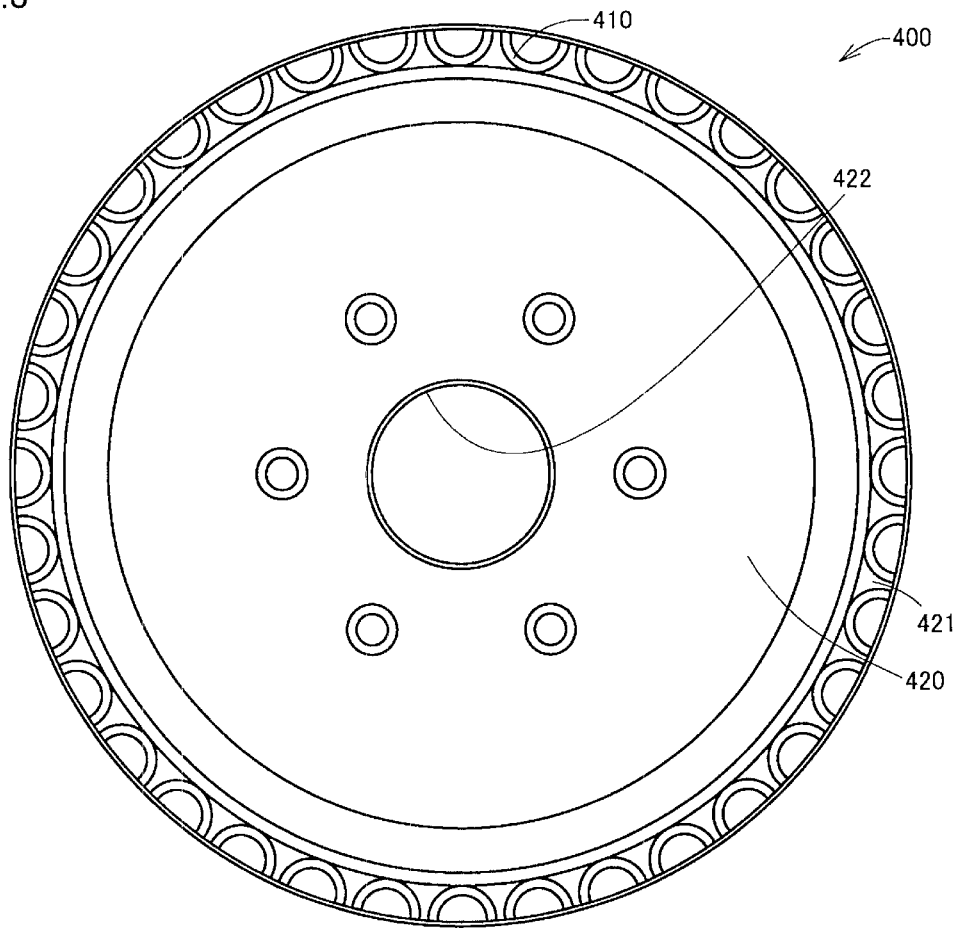
FIG. 8 is a plan view of a superabrasive wheel according to a fourth embodiment of the present invention.
Figure 9:
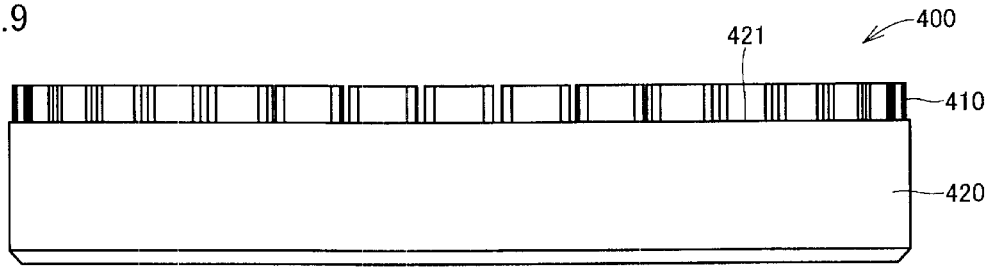
FIG. 9 is a side elevational view of the superabrasive wheel shown in FIG. 8.

As shown in FIGS. 8 and 9, a superabrasive wheel 400 according to a fourth embodiment of the present invention is formed by a cup-shaped base plate 420 made of an aluminum alloy or the like and a plurality of superabrasive layers or members 410, having a curvedly bent plate shape, fixed onto a single end surface 421 of the base plate 420 at intervals from each other along the peripheral direction. In this embodiment, the curvedly bent plate shape of the superabrasive layers 410 is a plate shape bent to have a curved surface, i.e., a shape provided with a curved portion having a radius of curvature, dissimilarly to the superabrasive wheel 300 shown in FIGS. 4 to 7.

In each of the aforementioned first and second embodiments (the superabrasive wheel 100 shown in FIGS. 1 and 2 and the superabrasive wheel 200 shown in FIG. 3), a vitrified bond is employed as a binder. In each of the aforementioned third and fourth embodiments (the superabrasive wheel 300 shown in FIGS. 4 to 7 and the superabrasive wheel 400 shown in FIGS. 8 and 9), a vitrified bond or a resin bond is preferably employed while a metal bond or an electrodeposition bond may be employed as the binder. Ceramics-based glass is preferably employed for the vitrified bond, which is more preferably in a porous structure. Phenol-based resin is preferably employed for the resin bond, to which a filler is more preferably added.

In any embodiment of the superabrasive wheel according to the present invention, the superabrasive layers are preferably bonded to the single end surface of the base plate with a resin-based adhesive or by brazing.

EXAMPLES

Superabrasive wheels according to Examples of the present invention and superabrasive wheels according to comparative examples were manufactured for performing a mirror finishing test with each superabrasive wheel in an in-feed grinding system. As an evaluation method for the mirror finishing test, a discoidal workpiece of single-crystalline silicon having a diameter of 100 mm was ground at a depth of cut (total depth of cut in roughing and finishing) of 35 $\mu$m, and this grinding was regarded as single working. Therefore, the quantity of single grinding was 274.9 $mm^3$. This grinding was continued for making evaluation with surface roughness Ra of the workpiece after working and a PV value, i.e., the maximum value (the maximum distance between a peak and a valley) of irregularity on the surface after working. All of the following surface roughness Ra and PV values were obtained after performing grinding five times.

Figure 10:
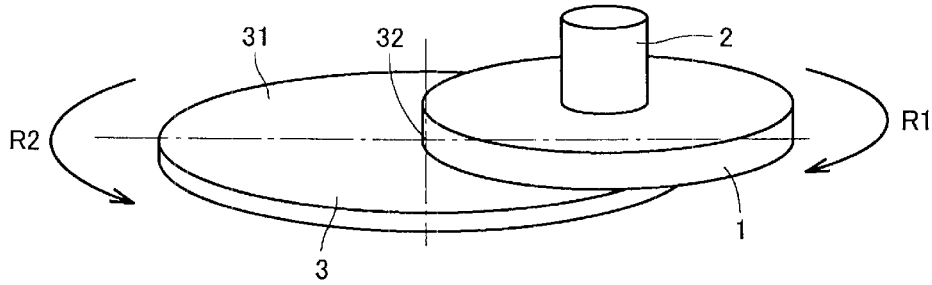
FIG. 10 is a perspective view schematically showing in-feed grinding.

As shown in FIG. 10, a superabrasive wheel 1 mounted on a rotary shaft 2 rotates along arrow R1 and a workpiece 3 rotates along arrow R2, for performing in-feed grinding. Referring to FIG. 10, superabrasive layers are fixed to the lower surface of the superabrasive wheel 1. The superabrasive wheel 1 is so provided that the superabrasive layers come into contact with a ground surface 31 of the workpiece 3. Thus, grinding is so performed that the superabrasive layers of the superabrasive wheel 1 regularly pass through a central portion 32 of the workpiece 3. Such grinding is referred to as the in-feed grinding system.

Example 1

A vitrified bond and diamond abrasive grains of #3000 in grain size (abrasive grain diameter: 2 to 6 $\mu$m) were homogeneously mixed with each other. This mixture was pressed at the room temperature and thereafter fired in a firing furnace at a temperature of 1100° C., for preparing diamond layers as superabrasive layers having a flat plate shape. The length of one side of the section of the flat plate shape was 4 mm, the thickness was 1 mm, and the height was 5 mm. Table 1 shows the composition of the vitrified bond.

TABLE 1

| | |
|---|---|
| $SiO_2$ | 62 weight % |
| $Al_2O_3$ | 17 weight % |
| $K_2O$ | 9 weight % |
| CaO | 4 weight % |
| $B_2O_3$ | 2 weight % |
| $Na_2O$ | 2 weight % |
| $Fe_2O_3$ | 0.5 weight % |
| MgO | 0.3 weight % |

Circumferential grooves of 4.5 mm in width were formed on a single end surface of a base plate of an aluminum alloy having an outer diameter of 200 mm and a thickness of 32 mm at a depth of 1 mm. The plurality of diamond layers obtained in the aforementioned manner were bonded to these grooves with an epoxy resin-based adhesive at intervals of 2.5 mm from each other so that the longitudinal direction of the flat-shaped sections of the diamond layers was along the radial direction of the base plate. Thus, a diamond wheel for mirror finishing shown in FIG. 1 was prepared.

The obtained diamond wheel was mounted on a vertical spindle rotary table surface grinder and subjected to truing and dressing with a diamond rotary dresser, for thereafter performing mirror finishing of single-crystalline silicon. Table 2 shows the mirror finishing conditions.

TABLE 2

| | |
|---|---|
| Wheel Size | ϕ200-32T |
| Workpiece | Single-Crystalline Silicon |
| Grinder | Vertical Spindle Rotary Table Surface Grinder |
| Rotational Frequency of Wheel | 3230 $min^{-1}$ |
| Peripheral Velocity of Wheel | 33.8 m/sec. |
| Total Depth of Cut in Roughing | 30 μm |
| Cutting Speed in Roughing | 20 μm/min |
| Total Depth of Cut in Finishing | 5 μm |
| Cutting Speed in Finishing | 5 μm/min. |
| Spark-Out | 30 sec. |
| Rotational Frequency of Workpiece | 100 r.p.m. |

Consequently, the diamond wheel was excellent in sharpness, and the workpiece was in an excellent state with surface roughness Ra of 0.015 μm, a PV value of 0.20 μm and a small number of scratches.

Example 2

A vitrified bond and diamond abrasive grains of #3000 in grain size (abrasive grain diameter: 2 to 6 μm) were homogeneously mixed with each other. This mixture was pressed at the room temperature and thereafter fired in a firing furnace at a temperature of 1100° C., for preparing diamond layers having a flat plate shape. The length of one side of the section of the flat plate shape was 4 mm, the thickness was 1 mm, and the height was 5 mm.

Circumferential grooves of 4.5 mm in width and 1 mm in depth were formed on a single end surface of a base plate of an aluminum alloy having an outer diameter of 200 mm and a thickness of 32 mm. The plurality of diamond layers obtained in the aforementioned manner were bonded to these grooves with an epoxy resin-based adhesive at intervals of 2.5 mm from each other so that the longitudinal direction of the section of the flat plate shape of the diamond layers was at an angle α of 20° with respect to the radial direction of the base plate, i.e., the radial direction of a superabrasive wheel. Thus, a diamond wheel for mirror finishing shown in FIG. 3 was prepared.

The obtained diamond wheel was mounted on a vertical spindle rotary table surface grinder and subjected to truing and dressing with a diamond rotary dresser, for thereafter performing mirror finishing of single-crystalline silicon. The mirror finishing conditions were similar to those for Example 1.

Consequently, the diamond wheel was excellent in sharpness, and the workpiece was in an excellent state with surface roughness Ra of 0.015 μm, a PV value of 0.21 μm and a small number of scratches.

Example 3

A vitrified bond and diamond abrasive grains of #3000 in grain size (abrasive grain diameter: 2 to 6 μm) were homogeneously mixed with each other. This mixture was pressed at the room temperature and thereafter fired in a firing furnace at a temperature of 1100° C., for preparing plate-shaped diamond layers having a V-shaped section. The length of one side of the V-shaped section was 4 mm, the thickness of the plate shape was 1 mm, the angle between two sides forming the V-shaped section was 90°, and the height of the diamond layers was 5 mm.

Circumferential grooves of 4.5 mm in width and 1 mm in depth were formed on a single end surface of a base plate of an aluminum alloy having an outer diameter of 200 mm and a thickness of 32 mm. The plurality of diamond layers obtained in the aforementioned manner were bonded to these grooves with an epoxy resin-based adhesive at intervals of 1 mm from each other so that the apical portions of the V-shaped sections were directed to the radial direction of the inner peripheral side of the base plate. Thus, a diamond wheel for mirror finishing shown in FIG. 4 was prepared.

The obtained diamond wheel was mounted on a vertical spindle rotary table surface grinder and subjected to truing and dressing with a diamond rotary dresser, for thereafter performing mirror finishing of single-crystalline silicon. The mirror finishing conditions were similar to those for Example 1.

Consequently, the diamond wheel was excellent in sharpness, and the workpiece was in an excellent state with surface roughness Ra of 0.015 μm, a PV value of 0.21 μm and a small number of scratches.

Figure 11:
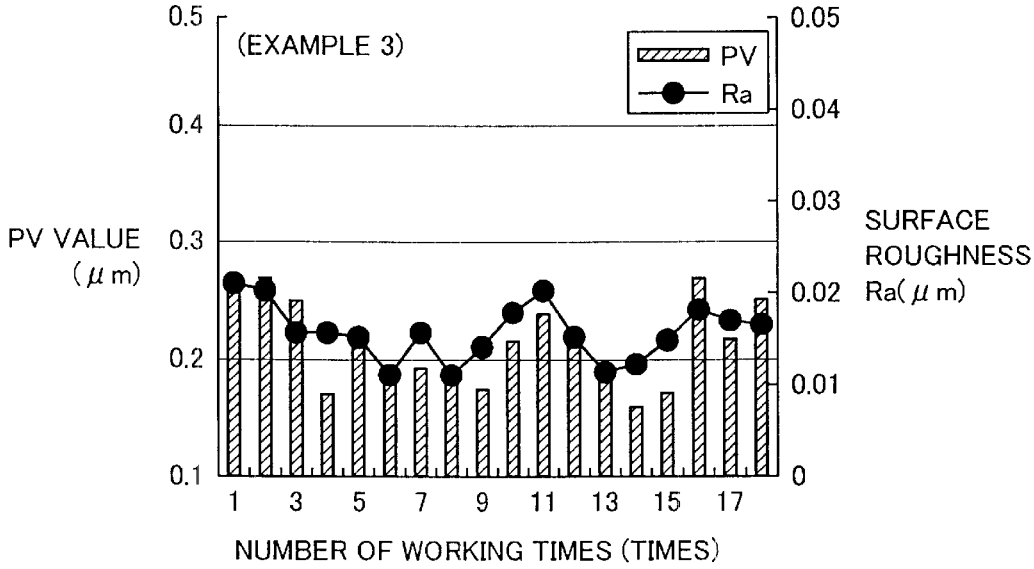
FIG. 11 is a diagram showing the relation between the number of working times, a PV value (the maximum width of irregularity on a worked surface of a workpiece, i.e., the maximum distance between a peak and a valley) of the workpiece and surface roughness Ra obtained as a result of a grinding test in Example 3 of the present invention.
Figure 12:
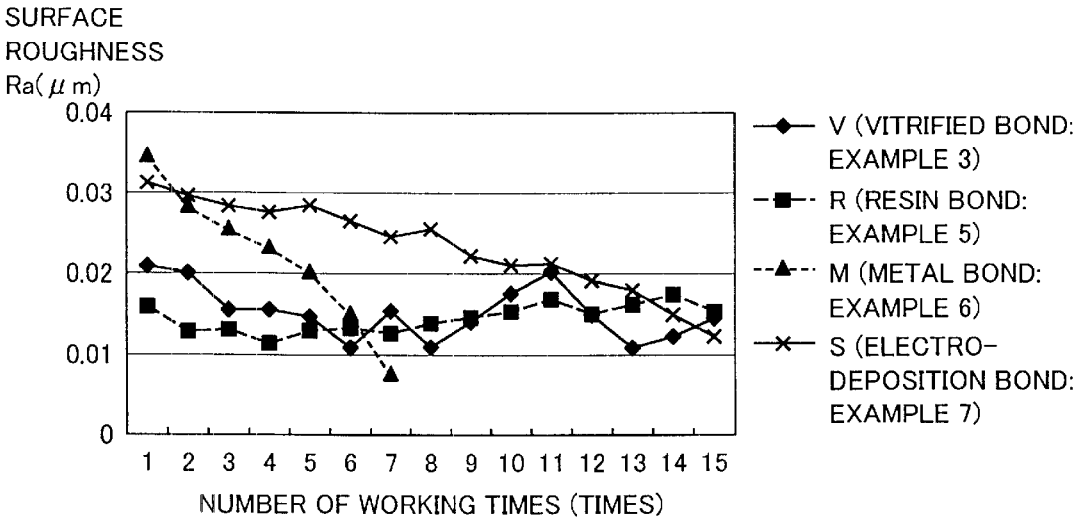
FIG. 12 is a diagram showing the relation between the number of working times and surface roughness of workpieces obtained as one of results of grinding tests in Examples 3, 5, 6 and 7 of the present invention.
Figure 13:
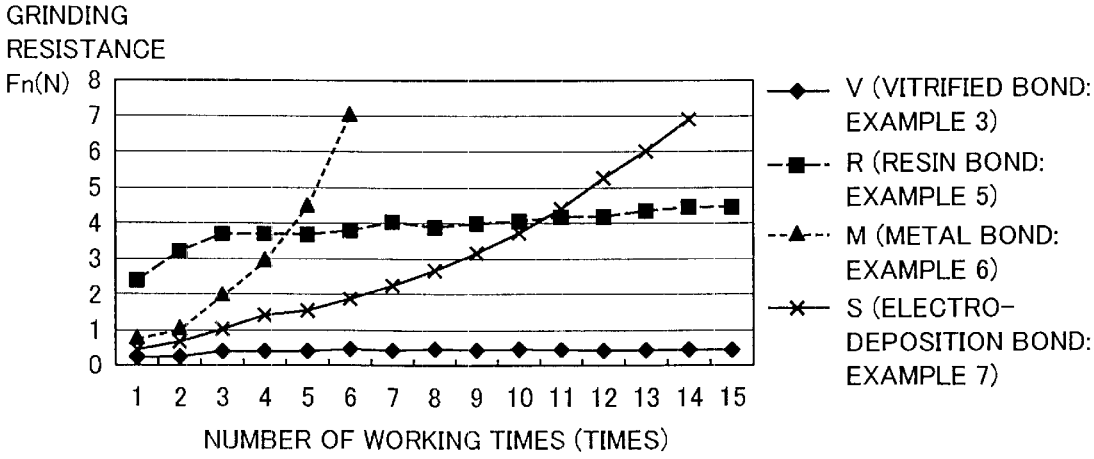
FIG. 13 is a diagram showing the relation between the number of working times and grinding resistance obtained as one of results of grinding tests in Examples 3, 5, 6 and 7 of the present invention.

The PV value and surface roughness of the workpiece varying with the number of working times were measured. FIG. 11 shows the results of the measurement. FIG. 12 shows the relation between the number of working times and the surface roughness of the workpiece, and FIG. 13 shows the relation between the number of working times and grinding resistance. It is understood from FIGS. 11 and 12 that the surface roughness and the PV value of the workpiece remain at relatively small levels and change in a small range also when the number of working times is increased. Further, it is understood from FIG. 13 that the grinding resistance is not much changed but kept at a small value also when the number of working times is increased. Therefore, the grinding resistance can be maintained low also when the quantity of working is increased, whereby not only scratches resulting from displacement of superabrasive layers can be prevented during grinding but the life of the superabrasive wheel can be increased.

Example 4

A vitrified bond and diamond abrasive grains of #3000 in grain size (abrasive grain diameter: 2 to 6 μm) were homogeneously mixed with each other. This mixture was pressed at the room temperature and thereafter fired in a firing furnace at a temperature of 1100° C., for preparing diamond layers having a plate shape and a semi-ring-shaped (semi-cylindrical) section. The radius of the semi-ring-shaped section was 4 mm, the thickness of the plate shape was 1 mm, and the height was 5 mm.

Circumferential grooves of 4.5 mm in width and 1 mm in depth were formed on a single end surface of a base plate of an aluminum alloy having an outer diameter of 200 mm and a thickness of 32 mm. The plurality of diamond layers obtained in the aforementioned manner were bonded to these grooves with an epoxy resin-based adhesive at intervals of 1 mm from each other so that bent portions of the semi-ring-shaped sections of the diamond layers were directed to the radial direction of the inner peripheral side of the base plate. Thus, a diamond wheel for mirror finishing shown in FIG. 8 was prepared.

The obtained diamond wheel was mounted on a vertical spindle rotary table surface grinder and subjected to truing and dressing with a diamond rotary dresser, for thereafter performing mirror finishing of single-crystalline silicon. The mirror finishing conditions were similar to those for Example 1.

Consequently, the diamond wheel was excellent in sharpness, and the workpiece was in an excellent state with surface roughness Ra of 0.018 μm, a PV value of 0.24 μm and a small number of scratches.

Example 5

A resin bond and diamond abrasive grains of #2400 in grain size (abrasive grain diameter: 4 to 8 μm) were homogeneously mixed with each other. This mixture was pressed at a temperature of 200° C. for preparing diamond layers having a plate shape and a V-shaped section. The length of one side of the V-shaped section was 4 mm, the thickness of the plate shape was 1 mm, the angle between two sides forming the V-shaped section was 90°, and the height of the diamond layers was 5 mm. The resin bond was mainly composed of phenol resin.

Circumferential grooves of 4.5 mm in width and 1 mm in depth were formed on a single end surface of a base plate of an aluminum alloy having an outer diameter of 200 mm and a thickness of 32 mm. The plurality of diamond layers obtained in the aforementioned manner were bonded to these grooves with an epoxy resin-based adhesive at intervals of 1 mm from each other so that the apical portions of the V-shaped sections of the diamond layers were directed to the radial direction of the inner peripheral side of the base plate. Thus, a diamond wheel for mirror finishing shown in FIG. 4 was prepared.

The obtained diamond wheel was mounted on a vertical spindle rotary table surface grinder and subjected to truing and dressing with a diamond rotary dresser, for thereafter performing mirror finishing of single-crystalline silicon. The mirror finishing conditions were similar to those for Example 1.

Consequently, the diamond wheel was excellent in sharpness, and the workpiece was in an excellent state with surface roughness Ra of 0.014 μm, a PV value of 0.18 μm and a small number of scratches.

The surface roughness and grinding resistance of the workpiece varying with the number of working times were measured. FIG. 12 shows the relation between the number of working times and the surface roughness of the workpiece, and FIG. 13 shows the relation between the number of working times and grinding resistance. It is understood from FIG. 12 that the surface roughness of the workpiece remains at a small level and changes in a small range also when the number of working times is increased. Further, it is understood from FIG. 13 that change of the grinding resistance is small also when the number of working times is increased, although the grinding resistance is higher as compared with the superabrasive wheel according to Example 3 employing the vitrified bond. Thus, it is understood that the superabrasive wheel according to Example 5 employing the resin bond, having higher grinding resistance as compared with the superabrasive wheel according to Example 3 employing the vitrified bond, exhibits an autogenous action similarly to the superabrasive wheel employing the vitrified bond, and is improved in sharpness.

Example 6

A metal bond and diamond abrasive grains of #2400 in grain size (abrasive grain diameter: 4 to 8 μm) were homogeneously mixed with each other. This mixture was pressed at the room temperature and thereafter sintered by hot pressing, thereby preparing diamond layers having a plate shape and a V-shaped section. The length of one side of the V-shaped section was 4 mm, the thickness of the plate shape was 1 mm, the angle between two sides forming the V-shaped section was 90°, and the height was 5 mm. The metal bond was prepared from a copper-tin-based alloy.

Circumferential grooves of 4.5 mm in width and 1 mm in depth were formed on a single end surface of a base plate of an aluminum alloy having an outer diameter of 200 mm and a thickness of 32 mm. The plurality of diamond layers obtained in the aforementioned manner were bonded to these grooves with an epoxy resin-based adhesive at intervals of 1 mm from each other so that the apical portions of the V-shaped sections of the diamond layers were directed to the radial direction of the inner peripheral side of the base plate. Thus, a diamond wheel for mirror finishing shown in FIG. 4 was prepared.

The obtained diamond wheel was mounted on a vertical spindle rotary table surface grinder and subjected to truing and dressing with a diamond rotary dresser, for thereafter performing mirror finishing of single-crystalline silicon. The mirror finishing conditions were similar to those for Example 1.

Consequently, the workpiece was in an excellent state with surface roughness Ra of 0.021 μm, a PV value of 0.24 μm and a small number of scratches.

However, sharpness of this diamond wheel was inferior in sustainability as compared with the superabrasive wheel according to Example 3 employing the vitrified bond or the superabrasive wheel according to Example 5 employing the resin bond, and further deteriorated as the working was repeated. A number of gossans were caused on the surface of the workpiece. The surface roughness and grinding resistance of the workpiece varying with the number of working times were measured. FIG. 12 shows the relation between the number of working times and the surface roughness of the workpiece, and FIG. 13 shows the relation between the number of working times and grinding resistance. It is understood from FIGS. 12 and 13 that a superabrasive wheel employing a metal bond has no autogenous action but exhibits such a phenomenon that the surface of the metal bond is exposed and surface roughness of the workpiece is reduced when superabrasive grains are worn, while the grinding resistance is increased, the sharpness is deteriorated and gossans are caused on the surface of the workpiece.

Example 7

Figure 14:
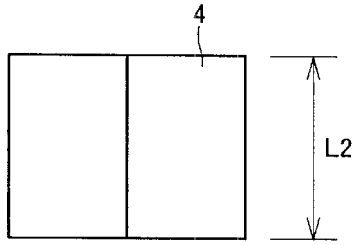
FIG. 14 is a plan view showing a conductive mold employed for forming an electrodeposition diamond layer in Example 7 of the present invention.
Figure 15:
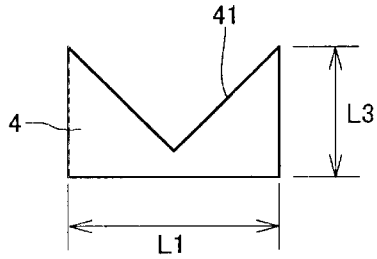
FIG. 15 is a side elevational view showing the conductive mold employed for forming he electrodeposition diamond layer in Example 7 of the present invention.

A number of conductive molds 4 shown in FIGS. 14 and 15 were prepared for forming electrodeposition diamond layers by performing electrodeposition on V-shaped slopes 41 of the conductive molds 4. The dimensions L1, L2 and L3 of the molds 4 were 6 mm, 5 mm and 4 mm respectively. V-shaped depressions were formed on the upper surfaces of the molds 4. The molds 4 were introduced into a nickel sulfamide bath for fixing diamond abrasive grains of #2400 in grain size (abrasive grain diameter: 4 to 8 μm) to the upper surfaces of the molds by electrocasting, thereby forming diamond layers of 0.7 mm in thickness. Thereafter the diamond layers were separated from the molds for preparing diamond layers having a plate shape and a V-shaped section. The length of one side of the V-shaped section was 4 mm, the thickness of the plate shape was 1 mm, the angle between two sides forming the V-shaped section was 90°, and the height was 5 mm.

Circumferential grooves of 4.5 mm in width and 1 mm in depth were formed on a single end surface of a base plate of an aluminum alloy having an outer diameter of 200 mm and a thickness of 32 mm. The plurality of diamond layers obtained in the aforementioned manner were bonded to these grooves with an epoxy resin-based adhesive at intervals of 1 mm from each other so that the apical portions of the V-shaped sections were directed to the radial direction of the inner peripheral side of the base plate. Thus, a diamond wheel shown in FIG. 4 was prepared.

The obtained diamond wheel was mounted on a vertical spindle rotary table surface grinder and subjected to truing and dressing with a diamond rotary dresser, for thereafter performing mirror finishing of single-crystalline silicon. The mirror finishing conditions were similar to those for Example 1.

Consequently, the workpiece was in an excellent state with surface roughness Ra of 0.029 μm, a PV value of 0.32 μm and a small number of scratches.

However, sharpness of this diamond wheel was inferior in sustainability as compared with the superabrasive wheel according to Example 3 employing the vitrified bond or the superabrasive wheel according to Example 5 employing the resin bond, and further deteriorated as the working was repeated. Further, gossans were caused on the surface of the workpiece as the quantity of working was increased, to result in a number of scratches. The surface roughness and grinding resistance of the workpiece varying with the number of working times were measured. FIG. 12 shows the relation between the number of working times and the surface roughness of the workpiece, and FIG. 13 shows the relation between the number of working times and grinding resistance. It is understood from FIGS. 12 and 13 that superabrasive grains are worn in a superabrasive wheel employing an electrodeposition bond, the superabrasive wheel has no autogenous action, and grinding resistance is increased as the number of working times is increased, to deteriorate the sharpness.

Comparative Example 1

A vitrified bond and diamond abrasive grains of #3000 in grain size (abrasive grain diameter: 2 to 6 μm) were homogeneously mixed with each other. This mixture was pressed at the room temperature and thereafter fired in a firing furnace at a temperature of 1100° C., for preparing ring-shaped diamond layers of 200 mm in outer diameter and 3 mm in width. Grooves (bottomed) of 1 mm in width were formed on working surfaces of the ring-shaped diamond layers at regular intervals to divide the working surfaces from the outer peripheral sides toward the inner peripheral sides, while setting the circumferential length of superabrasive layers defined between the grooves to 3 mm.

The ring-shaped diamond layers were bonded to a single end surface of a base plate of an aluminum alloy having an outer diameter of 200 mm and a thickness of 32 mm with an epoxy resin-based adhesive. Thus, a diamond wheel shown in FIG. 16 was prepared.

Figure 16:
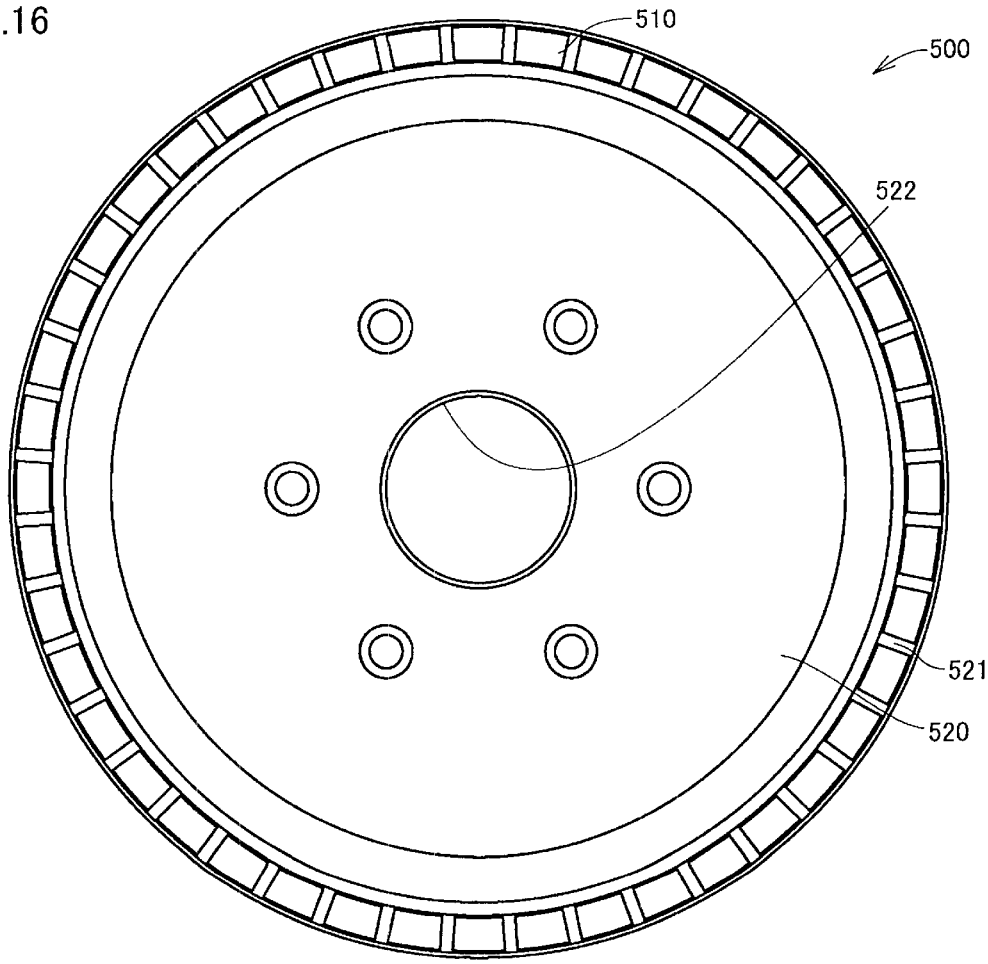
FIG. 16 is a plan view showing a superabrasive wheel formed according to comparative example 1 of the present invention.

As shown in FIG. 16, ring-shaped superabrasive layers 510 are fixed onto a single end surface 521 of a base plate 520 to have grooves of 1 mm in width. A hole 522 for receiving the rotary shaft of a superabrasive wheel 500 is provided on the central portion of the base plate 520.

The obtained diamond wheel was mounted on a vertical spindle rotary table surface grinder and subjected to truing and dressing with a diamond rotary dresser, for thereafter performing mirror finishing of single-crystalline silicon. The mirror finishing conditions were similar to those for Example 1.

Figure 17:
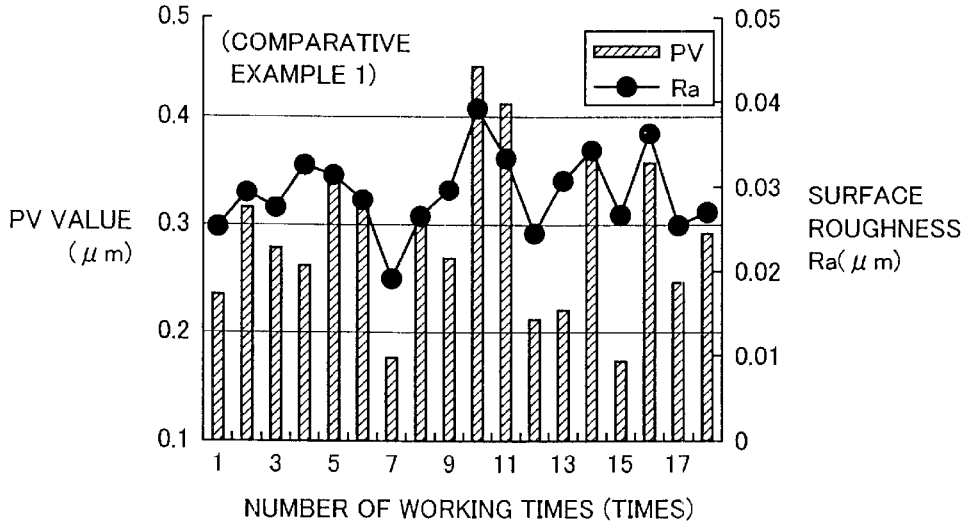
FIG. 17 is a diagram showing the relation between the number of working times, a PV value of a workpiece and surface roughness Ra obtained as a result of a grinding test in comparative example 1 of the present invention.

Consequently, the surface roughness Ra and the PV value of the workpiece were 0.031 μm and 0.34 μm respectively and scratches were concentrically caused on the central portion of the workpiece, although the diamond wheel was excellent in sharpness. The surface roughness and the PV value of the workpiece varying with the number of working times were measured. FIG. 17 shows the results. It is understood from FIG. 17 that the surface roughness Ra and the PV value of the workpiece remarkably vary with the number of working times and the values thereof are relatively large as compared with the superabrasive wheel according to Example 3.

A diamond wheel similar to the above was prepared by manufacturing a plurality of segment diamond layers having arcs of 200 mm in outer diameter, widths of 3 mm and peripheral lengths of 3 mm, arranging the same at regular intervals of 1 mm in the form of a ring and bonding the same to a single end surface of a base plate. Also when this diamond wheel was employed for mirror-finishing single-crystalline silicon, results similar to the above were obtained.

Comparative Example 2

A resin bond and diamond abrasive grains of #2400 in grain size (abrasive grain diameter: 4 to 8 μm) were homogeneously mixed with each other. This mixture was pressed at a temperature of 200° C., for preparing diamond layers having a flat plate shape. The plurality of diamond layers having a flat plate shape similarly to those in Example 1 were bonded to a single end surface of a base plate with a resin bond similar to that in Example 5 by a method similar to that in Example 1. Thus, a diamond wheel for mirror grinding shown in FIG. 1 was prepared.

The obtained diamond wheel was mounted on a vertical spindle rotary table surface grinder and subjected to truing and dressing with a diamond rotary dresser, for thereafter performing mirror finishing of single-crystalline silicon. The mirror finishing conditions were similar to those for Example 1.

Consequently, the workpiece was in an excellent state with surface roughness Ra of 0.013 μm, a PV value of 0.18 μm and a small number of scratches, while a working load was increased as the number of working times was increased, and the superabrasive layers were displaced from the base plate in 14-th working. This resulted in scratches, and the superabrasive wheel was unusable.

Comparative Example 3

A metal bond and diamond abrasive grains of #2400 in grain size (abrasive grain diameter: 4 to 8 μm) were homogeneously mixed with each other. This mixture was pressed at the room temperature and thereafter sintered by hot pressing, for preparing diamond layers having a flat plate shape. The plurality of diamond layers having a flat plate shape similarly to those in Example 1 were bonded to a single end surface of a base plate with an epoxy resin-based adhesive with a metal bond similar to that in Example 6 by a method similar to that in Example 1. Thus, a diamond wheel for mirror finishing shown in FIG. 1 was prepared.

The obtained diamond wheel was mounted on a vertical spindle rotary table surface grinder and subjected to truing and dressing with a diamond rotary dresser, for thereafter performing mirror finishing of single-crystalline silicon. The mirror finishing conditions were similar to those for Example 1.

Consequently, the workpiece was in an excellent state with surface roughness Ra of 0.021 μm, a PV value of 0.23 μm and a small number of scratches, while a working load was increased as the number of working times was increased, and the superabrasive layers were displaced from the base plate in eighth working. This resulted in scratches on the workpiece, and the superabrasive wheel was unusable.

Comparative Example 4

A vitrified bond and diamond abrasive grains of #3000 in grain size (abrasive grain diameter: 2 to 6 μm) were homogeneously mixed with each other. This mixture was pressed at the room temperature and thereafter fired in a firing furnace at a temperature of 1100° C., for preparing plate-shaped diamond layers having a V-shaped section. The length of one side of the V-shaped section was 4 mm, the thickness of the plate shape was 1 mm, the angle between two sides forming the V-shaped section was 90°, and the height was 10 mm.

Figure 18:
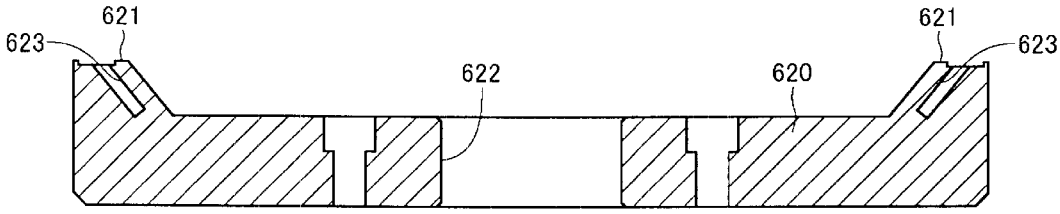
FIG. 18 is a partially fragmented sectional view showing a base plate provided with a hole for mounting a superabrasive layer on an end surface of the base plate in comparative example 4 of the present invention.

A base plate of an aluminum alloy having an outer diameter of 200 mm and a thickness of 32 mm was employed. As shown in FIG. 18, holes 623 of 6 mm in diameter were formed on a single end surface 621 of a base plate 620 by a number suitable for receiving the diamond layers. The axes of these holes 623 are inclined toward the outer peripheral side of the diamond wheel at an angle of 45°.

Figure 19:
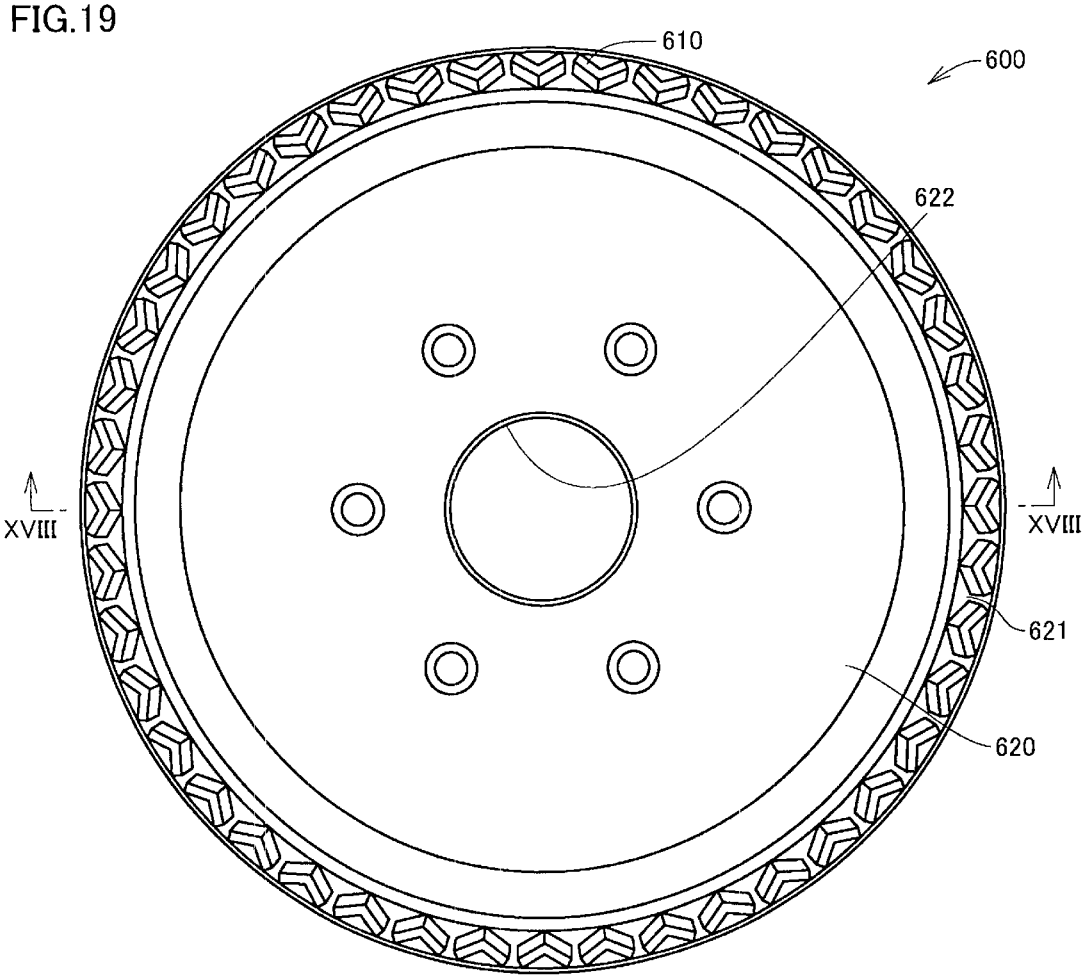
FIG. 19 is a plan view of a superabrasive wheel formed according to comparative example 4 of the present invention

The plurality of plate-shaped diamond layers having a V-shaped section were inserted in the holes 623 of 6 mm in diameter formed in the single end surface 621 of the base plate 620 respectively, and bonded with an epoxy resin-based adhesive. Thus, a diamond wheel shown in FIG. 19 was prepared. As shown in FIG. 19, each plate-shaped superabrasive layer 610 having a V-shaped section is fixed onto the single end surface 621 of the base plate 620, and has a peripheral end surface inclined by the angle of 45° toward the outer peripheral side with respect to the rotary shaft of the superabrasive wheel 620. A hole 622 for receiving the rotary shaft of the superabrasive wheel 600 is formed on the central portion of the base plate 620.

The obtained diamond wheel was mounted on a vertical spindle rotary table surface grinder and subjected to truing and dressing with a diamond rotary dresser, for thereafter performing mirror finishing of single-crystalline silicon. The mirror finishing conditions were similar to those for Example 1.

Consequently, the diamond layers were partially chipped due to pressure applied to the diamond wheel during grinding, although the diamond wheel was excellent in sharpness. The surface roughness Ra and the PV value of the workpiece were 0.018 μm and 0.36 μm respectively, and scratches resulting from the chipped superabrasive layers were observed on the surface of the workpiece.

From the aforementioned results of Examples and comparative examples, it has been confirmed that the diamond wheel for mirror finishing according to Example of the present invention has a smaller number of scratches caused on a workpiece, can obtain high-precision surface roughness and is excellent in dischargeability for shavings and chips as compared with the conventional diamond wheel or the diamond wheel according to comparative example.

The embodiments and Examples disclosed above are to be considered illustrative in all points and not restrictive. The scope of the present invention is shown not by the aforementioned embodiments or Examples but by the scope of the claims for patent, and is intended to include all corrections and modifications within the meaning and range equivalent to the scope of the claims for patent.

The superabrasive wheel according to the present invention is suitably employed for mirror-finishing a hard brittle material such as silicon, glass, ceramics, ferrite, rock crystal, cemented carbide or the like.

What is claimed is:

1. A superabrasive wheel (100, 200) for mirror finishing comprising:

an annular base plate (120, 220) having an annular end surface (121, 221) that is circularly annular about a central axis; and a plurality of superabrasive members (110, 210), each having a radially outer peripheral end surface (111), arranged along a periphery of said annular base plate (120, 220), wherein said superabrasive members are spaced apart at intervals from each other in a circumferential direction around said central axis and are fixed onto said end surface (121, 221) of said base plate (120, 220), wherein each one of said superabrasive members (110, 210) has a quadrilateral plate shape confined to extending along a respective flat plane and is so arranged that said radially outer peripheral end surface (111) is substantially parallel to said central axis, each one of said superabrasive members has a base surface (113) extending along a thickness of said plate shape perpendicularly to said respective flat plane, wherein said base surface is fixed onto said annular end surface (121, 221) of said base plate (120, 220), and said superabrasive members respectively comprise superabrasive grains bonded by a binder of a vitrified bond.

2. The superabrasive wheel for mirror finishing according to claim 1, wherein said superabrasive members (110, 210) have working surfaces (112) that are substantially perpendicular to said central axis and that all together have a total working area with a ratio of at least 5% and not more than 80% relative to an area of a ring shape defined between a first circle connecting said radially outer peripheral end surfaces of said superabrasive members (110, 210) with each other and a second circle connecting radially inner peripheral edges of said superabrasive members (110, 210) opposite said radially outer peripheral end surfaces with each other.

3. The superabrasive wheel for mirror finishing according to claim 1, wherein said superabrasive members (110, 210) contain said superabrasive grains having a mean grain size of at least 0.1 μm and not more than 100 μm.

4. A superabrasive wheel (300, 400) for mirror finishing comprising:

an annular base plate (320, 420) having an annular end surface (321, 421) that is circularly annular about a central axis; and a plurality of superabrasive members (310, 410), arranged spaced apart at intervals from each other in a circumferential direction around said central axis and fixed onto said end surface (321, 421) of said base plate (320, 420), wherein each one of said superabrasive members (310, 410) has a sectional shape on a section plane parallel to said annular end surface of said base plate, wherein said sectional shape has two legs that are joined to each other on a radially inner side, that terminate at two respective free edges on a radially outer side along a periphery of said annular end surface, and that bound therebetween a space that is open radially outwardly between said two legs, and each one of said superabrasive members has a base surface (313) that extends parallel to said annular end surface and extends along a thickness of said two legs, and that is fixed onto said annular end surface (321, 421) of (said base plate (320, 420).

5. The superabrasive wheel for mirror finishing according to claim 4, wherein each one of said superabrasive members comprises superabrasive grains bonded by a binder of a vitrified bond.

6. The superabrasive wheel for mirror finishing according to claim 4, wherein each one of said superabrasive members comprises superabrasive grains bonded by a binder of a resin bond.

7. The superabrasive wheel for mirror finishing according to claim 4, wherein each one of said superabrasive members (310, 410) has an angularly bent portion (314) located on said radially inner side where said two legs are joined to each other.

8. The superabrasive wheel for mirror finishing according to claim 4, wherein said sectional shape of each one of said superabrasive members (310) has a V-shape formed by said two legs.

9. The superabrasive wheel for mirror finishing according to claim 8, wherein said V-shape has an apex where said two legs are joined to each other, wherein said apex has an apex angle of at least 30° and not more than 150°.

10. The superabrasive wheel for mirror finishing according to claim 4, wherein said sectional shape of each one of said superabrasive members (410) has a curved shape with a curved surface formed by said two legs joined to each other.

11. The superabrasive wheel for mirror finishing according to claim 4, wherein said superabrasive members (310, 410) have working surfaces (312) that are substantially perpendicular to said central axis, and that have a total working area with a ratio of at least 5% and not more than 80% relative to an area of a ring shape defined between a first circle connecting said free edges of said legs of said superabrasive members (310, 410) with each other and a second circle connecting with each other inner peripheral bounds of said superabrasive members (310, 410) where said two legs are respectively joined to each other.

12. The superabrasive wheel for mirror finishing according to claim 4, wherein said superabrasive members (310, 410) contain superabrasive grains having a mean grain size of at least 0.1 $\mu$m and not more than 100 $\mu$m.

13. A superabrasive finishing wheel comprising:

an annular base plate having an annular end surface that is circularly annular about a central axis and that extends along a base plane perpendicular to said central axis; and a plurality of superabrasive members that each respectively comprise a binder and superabrasive grains dispersed and bonded in said binder, and that are arranged on said annular end surface spaced apart from one another at intervals in a circumferential direction around said central axis;

wherein:

each respective superabrasive member of said superabrasive members has a base edge surface that is fixed onto said annular end surface of said annular base plate, a working edge surface opposite said base edge surface, a protrusion height of said superabrasive member protruding from said annular end surface between said base edge surface and said working edge surface, a uniform cross-sectional shape of said base edge surface and said working edge surface and at each cross-section plane parallel to said base plane between said base edge surface and said working edge surface, first and second major surfaces that are opposite each other, protrude outwardly from said annular end surface between said base edge surface and said working edge surface, and bound said cross-sectional shape therebetween, and a uniform thickness between said first and second major surfaces; and each said superabrasive member has a configuration selected from the group consisting of:

a first configuration in which said first and second major surfaces are flat planar surfaces that are parallel to each other and that each have a parallelogram plane shape, and said cross-sectional shape is a parallelogram shape; and a second configuration in which said first and second major surfaces are non-planar surfaces which bound two legs of said cross-sectional shape therebetween, said two legs respectively terminate at two free edges oriented outwardly away from said central axis, said two legs are joined to each other at a junction oriented inwardly toward said central axis, and said two legs bound therebetween a space that is open between said two free edges radially outwardly away from said central axis.

14. The superabrasive finishing wheel according to claim 13, wherein said protrusion height is greater than said thickness between said first and second major surfaces, said thickness is a smallest outer dimension of each said superabrasive member, and an area of said base edge surface and of said working edge surface is smaller than an area of said first major surface and of said second major surface.

15. The superabrasive finishing wheel according to claim 13, wherein each said superabrasive member has said first configuration.

16. The superabrasive finishing wheel according to claim 15, wherein said first and second major surfaces of each said superabrasive member extend parallel to a respective radial plane extending radially from said central axis through said respective superabrasive member.

17. The superabrasive finishing wheel according to claim 15, wherein said first and second surfaces of each said superabrasive member extend at an acute angle relative to a respective radial plane extending radially from said central axis and through said respective superabrasive member.

18. The superabrasive finishing wheel according to claim 13, wherein each said superabrasive member has said second configuration.

19. The superabrasive finishing wheel according to claim 18, wherein said first and second major surfaces are each respectively a compound surface comprising two planar surface portions that extend at an angle relative to one another and meet one another along an intersection line at said junction of said two legs, so that said cross-sectional shape is a V-shape formed by said two legs.

20. The superabrasive finishing wheel according to claim 19, wherein said angle at which said two planar surface portions extend relative to each other defines a span angle of said V-shape, which is in a range from 45° to 90°.

21. The superabrasive finishing wheel according to claim 18, wherein said first and second major surfaces each comprise curved surfaces, so that said cross-sectional shape is a C-shape formed by said two legs.

22. The superabrasive finishing wheel according to claim 21, wherein said curved surfaces each have a curvature along a respective circular arc.

23. The superabrasive finishing wheel according to claim 13, wherein said annular end surface comprises an annular groove in an annular end face of said base plate, and said base edge surfaces of said superabrasive members are seated into and fixed in said annular groove.

* * * * *